United States Patent [19]

Walters

[11] Patent Number: 4,709,486

[45] Date of Patent: Dec. 1, 1987

[54] METHOD OF DETERMINING THE ORIENTATION OF A SURVEYING INSTRUMENT IN A BOREHOLE

[75] Inventor: Philip H. Walters, Austin, Tex.

[73] Assignee: Tensor, Inc., Round Rock, Tex.

[21] Appl. No.: 860,020

[22] Filed: May 6, 1986

[51] Int. Cl.[4] ..... F21B 47/22

[52] U.S. Cl. ..... 33/304; 33/312; 33/316

[58] Field of Search ..... 33/304, 302, 312, 313, 33/328, 316

[56] References Cited

U.S. PATENT DOCUMENTS

| | | | |
|---|---|---|---|
| 3,791,043 | 2/1974 | Russell | 33/312 |
| 3,862,499 | 1/1975 | Isham et al. | 33/312 |
| 4,468,863 | 9/1984 | Van Steenwyk | 33/304 |
| 4,472,884 | 9/1984 | Engebretson | 33/312 |
| 4,507,958 | 4/1985 | Russell et al. | 33/304 |
| 4,510,696 | 4/1985 | Roesler | 33/304 |

OTHER PUBLICATIONS

Chadderdon, J. and W. T. Kittinger, "How to Get the Most from Non-Magnetic Colors for Directional Drilling", Oil & Gas Journal, Apr. 16, 1962, pp. 104–109.

*Primary Examiner*—Willis Little
*Attorney, Agent, or Firm*—Cox & Smith Inc.

[57] ABSTRACT

A method of determining the orientation of a surveying instrument in a borehole from measurements of the earth's gravitational and magnetic fields wherein the azimuth angle is calculated directly without correcting an apparent azimuth. Those measurements are used to calculate the borehole axial magnetic component at each orientation of the surveying instrument in the borehole, and the borehole axial magnetic component is used, along with those measurements, to directly calculate the proper azimuth angle. In a preferred embodiment, measurements are taken at a plurality of orientations in the borehole and the borehole axial magnetic component is calculated in simultaneous equations and then compared to insure the accuracy of the azimuth computation at each orientation. The orientations are preferably non-colinear.

15 Claims, No Drawings

METHOD OF DETERMINING THE ORIENTATION OF A SURVEYING INSTRUMENT IN A BOREHOLE

BACKGROUND OF THE INVENTION

The present invention relates to a method of determining the orientation of a surveying instrument in a borehole. More particularly, the present invention relates to a method of computing the azimuth of a surveying instrument at a particular orientation in a borehole from the measured gravitational and magnetic field data of the earth at that orientation without measuring and correcting an apparent azimuth.

A number of instruments have been described for determining the orientation of a borehole. See M. H. Haddock, Deep Borehole Surveys and Problems, McGraw-Hill Publishing (1931). One such instrument presently in use is mounted in the drill collar and utilizes three orthagonally positioned magnetometers and three orthagonally positioned accelerometers to provide voltage outputs which are proportional to the earth's gravitational and magnetic field vector components. See, for instance, U.S. Pat. Nos. 3,791,043, 3,862,499 and 4,163,324.

It is conventional practice for the results of a borehole survey to be expressed in terms of a series of values of an azimuth angle $\theta$ and an inclination angle $\phi$ taken along the length of the borehole. Those angles $\theta$ and $\phi$ are either measured or calculated from the magnetic and gravitational field data measured by the above-described accelerometers and magnetometers at a series of locations along the borehole. However, this type survey instrument is mounted in the drill string, and the drill string has its own magnetic field. See J. Chadderdon and W. T. Kittinger, "How to get the most from nonmagnetic collars for directional drilling," Oil and Gas Journal, Apr. 16, 1962, pp. 104–109. If azimuth is measured directly, the apparent azimuth must be corrected for the magnetic field of the drill string. If the azimuth angle is calculated, the magnetic field data must be corrected before that data is used to calculate the azimuth angle.

Methods for correcting that magnetic field data or the apparent azimuth angle are disclosed in U.S. Pat. Nos. 3,791,043 and 4,163,324. In brief, those methods involve an iterative calculation which corrects the apparent azimuth or the magnetic field measurements for the magnetic interference of the drill string.

Applicant has discovered that the azimuth angle can be calculated directly from the gravitational and magnetic field data without measuring the apparent azimuth and correcting that apparent azimuth for the magnetic field of the drill string. The result is that the azimuth can be calculated with a higher degree of accuracy and reliability than previously possible. The method of the present invention also lends itself to convenient computerized calculation. It is, therefore, an object of the present invention to provide a method of determining the orientation of a surveying instrument in a borehole which does not require the correction of the magnetic field data to calculate the azimuth angle of the instrument in the borehole.

It is another object of the present invention to provide a method for determining the orientation of a surveying instrument in a borehole which does not require the measurement and correction of an apparent azimuth.

It is another object of the present invention to provide a method of determining the orientation of a surveying instrument in a borehole comprising measuring the earth's gravitational and magnetic fields at a plurality of non-colinear orientations of a surveying instrument in a borehole, calculating the borehole axial magnetic component at each orientation directly from the gravitational and magnetic field measurements and computing the azimuth angle for each orientation directly from the gravitational and magnetic field measurements and the calculated borehole axial magnetic component.

It is another object of the present invention to provide a method of determining the orientation of a surveying instrument in a borehole width increased accuracy and reliability.

It is another object of the present invention to provide a method of determining the orientation of a surveying instrument in a borehole from the earth's measured gravitational field in the x, y and z axes and from the earth's measured magnetic field in the x and y axes.

A further object of the present invention is to provide a method of calculating the azimuth angle of a surveying instrument at a selected orientation in a borehole from the earth's gravitational and magnetic field data measured by that surveying instrument.

It is another object of the present invention to provide a method of calculating the inclination angle, dip and other survey data for a selected orientation of a survey instrument in a borehole from the earth's magnetic and gravitational field data measured by that survey instrument.

These and other objects and advantages will be clear to those skilled in the art who have the benefit of this disclosure from the following detail description of a preferred embodiment of the present invention.

SUMMARY OF THE INVENTION

Those objects and advantages are accomplished through the present invention by providing a method for determining the orientation of a surveying instrument in a borehole comprising measuring the earth's gravitational and magnetic fields at a plurality of non-colinear orientations of the surveying instrument in the borehole, calculating the borehole axial magnetic component at each orientation directly from the gravitational and magnetic field measurements, and computing the azimuth angle for each orientation directly from the gravitational and magnetic field measurements and the calculated borehole axial magnetic component. The azimuth angle is calculated directly from the gravitational and magnetic field measurements without correcting the magnetic field measurements.

DETAILED DESCRIPTION OF THE PREFERRED EMBODIMENT

The earth's gravitational and magnetic fields are measured with a surveying instrument or probe, such as that described in U.S. Pat. No. 4,163,324, which produces six outputs in the form of variable voltages proportional to the vector components of the local gravitational and magnetic fields. The voltage output of such a probe can be represented as $H_x$, $H_y$, and $H_z$ for the magnetic field measurements of the earth in the x, y and z axes, where the z axis lies along the longitudinal axis of the borehole and the x and y axes lie in a radial plane perpendicular to the longitudinal axis of the borehole, and as $G_x$, $G_y$ and $G_z$ for the gravitational field measurements of the earth in that same x, y, z coordinate system. $H_z$ is the component of the total magnetic field which is suspect due to the magnetic field of the drill string in which the probe is mounted along the longitudinal borehole axis.

Because the method of the present invention calculates $H_z$ from the measured $H_x$, $H_y$, $G_x$, $G_y$ and $G_z$ data from a selected orientation in the borehole, it is not necessary that the probe produce a voltage output for the earth's magnetic field along the z axis. Although the apparatus disclosed in U.S. Pat. No. 4,163,324 does produce an output corresponding to $H_z$, that output can simply be ignored. A probe with two orthagonally positioned magnetometers for measurement of the magnetic field in just the x and y axes, and therefore, with just five outputs, is also satisfactory for use with the method of the present invention.

The calculation of the magnetic field along the longitudinal borehole axis directly from the measured variables $H_x$, $H_y$, $G_x$, $G_y$ and $G_z$ is based upon the assumption that (1) the earth's gravitational field is constant and (2) the earth's magnetic field intensity is constant. Having made those assumptions, and based upon the rule that the total field intensity at a given orientation is the square root of the sum of the squares of the magnetic field intensity, the total field intensity at one orientation must equal the total field intensity at a second selected orientation, a relationship which can be expressed as:

$$H_{x1}^2+H_{y1}^2+H_{z1}^2=H_{x2}^2+H_{y2}^2+H_{z2}^2 \quad [1]$$

The same rule applies for the total gravitational field, so:

$$H_{x1}G_{x1}+H_{y1}G_{y1}+H_{z1}G_{z1}=H_{x2}G_{x2}+H_{y2}.G_{y2}+H_{z2}G_{z2} \quad [2]$$

At this point, a second assumption is made, and the basis for this assumption is the above-referenced article by Chadderdon and Kittinger which appeared in the Apr. 16, 1962 issue of The Oil and Gas Journal to the effect that the magnetic field due to the drill string (which is the variable which affects $H_z$) is all in the direction of the longitudinal (z) axis of the borehole, i.e., that the source of the error in $H_z$ is entirely along the longitudinal axis of the borehole or drill string having the surveying instrument mounted therein. Solving for $H_{z1}$ in equation [2], substituting into [1], and rearranging the resulting equation gives:

$$H_{z2} = (H_{x1}G_{x1} + H_{y1}G_{y1} + H_{z1}G_{z1} - H_{x2}G_{x2} - H_{y2}G_{y2})/G_{z2} \quad [3]$$

$$H_{x1}^2 + H_{x2}^2 + H_{y1}^2 + H_{y2}^2 + H_{z1}^2 - [(H_{x1}G_{x1} + H_{y1}G_{y1} + H_{z1}G_{z1} - H_{x2}G_{x2} - H_{y2}G_{y2})/G_{z2}]^2 = 0 \quad [4]$$

$$[H_{x1}^2 + H_{x2}^2 + H_{y1}^2 - H_{y2}^2] + H_{z1} - [H_{z1}G_{z1} + (H_{x1}G_{x1} + H_{y1}G_{y1} - H_{x2}G_{x2} - H_{y2}G_{y2})/G_{z2}]^2 = 0 \quad [5]$$

To simplify matters, we will do the following substitutions:

$$a = H_{x1}^2 - H_{x2}^2 + H_{y1}^2 - H_{y2}^2 \quad [6]$$

$$b = (H_{x1}G_{x1} + H_{y1}G_{y1} - H_{x2}G_{x2} - H_{y2}G_{y2})/G_{z2} \quad [7]$$

$$c = G_{z1}/G_{z2} \quad [8]$$

Substituting a, b and c into equation [5] gives:

$$a + H_{z1}^2 - [cH_{z1} + b]^2 = 0$$

$$a + H_{z1}^2 - c^2H_{z1}^2 - 2bcH_{z1} - b^2 = \quad [9]$$

$$H_{z1}^2[1 - c^2] - H_{z1}(2bc) + a - b^2 =$$

$$H_{z1}^2[1 - c^2] - H_{z1}(2bc) - (a - b^2) =$$

Solving for $H_{z1}$ with the quadratic equation:

$$H_{z1} = \frac{2bc \pm \sqrt{4b^2c^2 - 4(1 - c^2)(a - b^2)}}{2(1 - c^2)} \quad [10]$$

Equations [6]–[8] are then substituted back into equation [10] and the longitudinal boreholes axial magnetic component $H_{z1}$ can be solved for directly using only the earth's gravitational field data and the earth's magnetic field data in the x and y axes:

$$H_{z1} = \frac{(G_{z1}/G_{z1}^2)(H_{x1}G_{x1} + H_{y1}G_{y1} - H_{x2}G_{x2} - H_{y2}G_{y2}) \pm \sqrt{(G_{z1}/G_{z2}^2)}}{(H_{x1}G_{x1} + H_{y1}G_{y1} - H_{x2}G_{x2} - H_{y2}G_{y2})^2 - ((1 - G_{z1}/G_{z2}^2)(H_{x1} - H_{x2} + H_{y1} - H_{y2}) - (H_{x1}G_{x1} + H_{y1}G_{y1} - H_{x2}G_{x2} - H_{y2}G_{y2}/G_{z2})^2)/(1 - G_{z1}/G_{z2}^2)} \quad [11]$$

Due to the use of the quadratic equation, $H_{z1}$ can have two values at each orientation of the survey instrument in the borehole when solved by equation [11]. That ambiguity can be removed by calculating $H_z$ in simultaneous equations at a plurality of orientations and comparing each $H_z$ to determine whether each $H_z$ is within the realm of possible values. To accomplish that comparison effectively, each $H_z$ must be calculated from an orientation which is non-colinear within the $H_z$ to which it is compared. In a presently preferred embodiment, the probe is provided with sensors of about 0.05% linearity, and the method of the present invention provides an accurate calculation of $H_z$ with as little as 5° of hole turn. It is, of course, possible to calculate $H_z$ directly with only two orientations in situations in which there is no ambiguity.

Having provided a method for calculation of the borehole axial magnetic component, the next step is to calculate the actual azimuth angle using an equation which is derived as follows. The starting point is an x, y, z coordinate system oriented along the earth's actual gravitational and magnetic fields and having vector components $G_x$, $G_y$, $G_z$, $H_x$, $H_y$, and $H_z$, respectively:

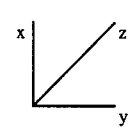

That coordinate system is rotated from the position $\theta$, $\phi$, $\alpha$ (where $\theta$ is the azimuth angle, $\phi$ is the inclination angle, and $\alpha$ is the gravitational toolface) to a coordinate system in which the z axis is down and the y axis is pointed along the axis of the borehole. "Toolface" refers to the angle between the y axis of the survey instrument and 90° from the radial, measured and looking in the direction of the positive z axis:

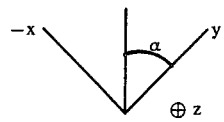

To accomplish that rotation requires a negative rotation of around the z axis to achieve 0 toolface (i.e., $\alpha=0$):

$$\begin{bmatrix} \cos\alpha & \sin\alpha & 0 \\ -\sin\alpha & \cos\alpha & 0 \\ 0 & 0 & 1 \end{bmatrix}$$

The next step is to rotate that coordinate system around the x axis (which is horizontal as a result of the previous rotation) so that z points down. This rotation requires a positive rotation of $\phi$:

$$\begin{bmatrix} 1 & 0 & 0 \\ 0 & \cos\phi & -\sin\phi \\ 0 & \sin\phi & \cos\phi \end{bmatrix}$$

The two matrices are then combined:

$$\begin{bmatrix} \cos\alpha & \sin\alpha & 0 \\ -\sin\alpha & \cos\alpha & 0 \\ 0 & 0 & 1 \end{bmatrix} \begin{bmatrix} 1 & 0 & 0 \\ 0 & \cos\phi & -\sin\phi \\ 0 & \sin\phi & \cos\phi \end{bmatrix} =$$

-continued $$\begin{bmatrix} \cos\alpha & \sin\alpha\cos\phi & -\sin\alpha\sin\phi \\ -\sin\alpha & \cos\alpha\cos\phi & -\cos\alpha\sin\phi \\ 0 & \sin\phi & \cos\phi \end{bmatrix}$$

The resulting matrix is then used to rotate the data from the earth's magnetic field ($H_x$, $H_y$, and $H_z$) into a coordinate system in which z is down and y is along the borehole axis in the radial plane. That new coordinate system is represented as $\hat{H}_x$, $\hat{H}_y$, $\hat{H}_z$:

$$[H_x, H_y, H_z] = [H_x, H_y, H_z] \cdot \begin{bmatrix} \cos\alpha & \sin\alpha\cos\phi & -\sin\alpha\sin\phi \\ -\sin\alpha & \cos\alpha\cos\phi & -\cos\alpha\sin\phi \\ 0 & \sin\phi & \cos\phi \end{bmatrix}$$

$$\hat{H}_x = H_x \cos\alpha - H_y \sin\alpha \quad [12]$$

$$\hat{H}_y = H_x \sin\alpha \cos\phi + H_y \cos\alpha \cos\phi + H_z \sin\phi \quad [13]$$

$$\hat{H}_z = -H_x \sin\alpha \sin\phi - H_y \cos\alpha \sin\phi + H_z \cos\phi \quad [14]$$

Sin $\alpha$, cos $\alpha$, sin $\phi$ and cos $\phi$ can be expressed in terms of $G_x$, $G_y$ and $G_z$ as follows:

$$\cos\phi = -G_z/\sqrt{G_x^2 + G_y^2 + G_z^2} \quad [15]$$

$$\sin\phi = \sqrt{G_x^2 + G_y^2}\,/\sqrt{G_x^2 + G_y^2 + G_z^2} \quad [16]$$

$$\cos = G_y/\sqrt{G_x^2 + G_y^2} \quad [17]$$

$$\sin = G_x/\sqrt{G_x^2 + G_y^2} \quad [18]$$

Substituting [15]–[18] into equations [12] and [14]:

$$H_x = H_x(G_y/\sqrt{G_x^2 + G_y^2}) - H_y(G_x/\sqrt{G_x^2 + G_y^2}) \quad [19]$$

$$= (H_xG_y - H_yG_x)/\sqrt{G_x^2 + G_y^2}$$

$$H_y = (H_x(G_x/\sqrt{G_x^2 + G_y^2})(G_z/\sqrt{G_x^2 + G_y^2G_z^2})) + (H_y(G_y/\sqrt{G_x^2 + G_y^2}) \quad [20]$$

$$(-G_z/\sqrt{G_x^2 + G_y^2 + G_z^2})) + (H_z(\sqrt{G_x^2 + G_y^2}\,/\sqrt{G_x^2 + G_y^2 + G_z^2}))$$

$$= \frac{(H_xG_x(-G_x)/\sqrt{G_x^2 + G_y^2}) + (H_yG_y(-G_z)/\sqrt{G_x^2 + G_y^2}) + (H_z\sqrt{G_x^2 + G_y^2})}{\sqrt{G_x^2 + G_y^2 + G_z^2}}$$

The azimuth angle can also be expressed as Atn($H_x/H_y$), therefore equations [19] and [20] are substituted into that expression as follows to enable computation of the azimuth angle:

$$\text{Azimuth} = Atn\left[\frac{(H_xG_y - H_yG_x)/\sqrt{G_x^2 + G_y^2}}{\dfrac{(H_xG_x(-G_x)/\sqrt{G_x^2 + G_y^2}) + (H_yG_y(-G_z)/\sqrt{G_x^2 + G_y^2}) + (H_z\sqrt{G_x^2 + G_y^2})}{\sqrt{G_x^2 + G_y^2 + G_z^2}}}\right]$$

That equation is simplied as follows:

$$\text{Azimuth} = Atn\left[\frac{(H_xG_y - H_yG_x)\sqrt{G_x^2 + G_y^2 + G_z^2} \,/\, \sqrt{G_x^2 + G_y^2}}{(H_xG_x(-G_z)/\sqrt{G_x^2 + G_y^2}) + (H_yG_y(-G_z)/\sqrt{G_x^2 + G_y^2}) + (H_z\sqrt{G_x^2 + G_y^2})}\right] \quad [21]$$

$$= Atn\left[\frac{(H_xG_y - H_yG_x)\sqrt{G_x^2 + G_y^2 + G_z^2}}{H_xG_x(-G_z) + H_yG_y(-G_z) + H_z(G_x^2 + G_y^2)}\right]$$

$G_z$ is bracketed and given a negative sign because it is common practice to install the $G_z$ accelerometer backwards, partly because gravity is considered an acceleration field pointing upwardly and partly because the $G_z$ accelerometer fits into the probe housing more easily when installed backwardly.

It is also possible to calculate other survey data directly from the measured $H_x$, $H_y$, $G_x$, $G_y$, $G_z$, and the calculated $H_z$. For instance, dip is calculated as follows. From substitution of equations [15]–[18] into equation [14]:

$$H_z = (-H_x(G_x/\sqrt{G_x^2 + G_y^2})(\sqrt{G_x^2 + G_y^2}\,/\,\sqrt{G_x^2 + G_y^2 + G_z^2}) - H_y(G_y/\sqrt{G_x^2 + G_y^2})(\sqrt{G_x^2 + G_y^2}\,/\,\sqrt{G_x^2 + G_y^2 + G_z^2}) + H_z(-G_z/\sqrt{G_x^2 + G_y^2 + G_z^2})) \quad [22]$$

$$= (-H_xG_x - H_yG_y - H_zG_z)/\sqrt{G_x^2 + G_y^2 + G_z^2}$$

Further, the sum of the squares of the total magnetic field intensities of coordinate system $H_x$, $H_y$, $H_z$ and $\hat{H}_x$, $\hat{H}_y$, $\hat{H}_z$ must be the same, therefore:

$$\sqrt{H_x^2 + H_y^2 + H_z^2} = \sqrt{H_x^2 + H_y^2 + H_z^2} \quad [23]$$

$$\sqrt{H_x^2 + H_y^2} = \sqrt{H_x^2 + H_y^2 + H_z^2 - H_z^2}$$

Dip can be expressed as $Atn(H_z/H_x^2+H_y^2)$, and equation [23] can be substituted into that expression as follows:

$$\text{Dip} = Atn\left[\frac{H_z}{\sqrt{H_x^2 + H_y^2 + H_z^2 - H_z^2}}\right] \quad [24]$$

Substituting equation [22] into equation [24]:

$$\text{Dip} = Atn\left[\frac{-H_xG_x - H_yG_y + H_z(-G_z)/\sqrt{G_x^2 + G_y^2 + G_z^2}}{H_x^2 + H_y^2 + H_z^2 - \left(\frac{-H_xG_x - H_yG_y + H_z(-G_z)}{\sqrt{G_x^2 + G_y^2 + G_z^2}}\right)}\right]$$

In a presently preferred embodiment, the gravitational and magnetic field data is taken as the probe is lowered on a drill string down into the borehole to be surveyed through a series of orientations of the probe in the borehole. The data is stored in memory, the probe is retrieved from the borehole, the data retrieved from the probe and the calculations are run on a separate computer. The probe is also lowered on a wireline and data transmitted to the separate computer from each orientation. These and other variations of the method of the present invention will be apparent to those skilled in the art who have the benefit of this disclosure, and it is expected that all such variations will fall within the spirit and scope of the following claims.

What is claimed is:

1. A method of determining the orientation of a surveying instrument in a borehole comprising:

measuring the radial components of the earth's magnetic field at a plurality of orientations of a surveying instrument in a borehole;

measuring the earth's gravitational field at a plurality of orientations of a surveying instrument in a borehole;

calculating the borehole axial magnetic component at each said orientation from said gravitational and the radial magnetic field measurements; and computing the azimuth angle of each said orientation directly from said gravitational and radial magnetic field measurements and the calculated borehole axial magnetic component.

2. The method of claim 1 wherein the orientations of the surveying instrument in the borehole are non-colinear.

3. The method of claim 1 additionally comprising calculating the dip angle directly from the gravitational and magnetic field measurements and the calculated borehole axial magnetic component.

4. The method of claim 1 additionally comprising comparing the calculated borehole axial magnetic component from a first orientation of the surveying instrument to the calculated borehole axial magnetic component from a second orientation of the surveying instrument.

5. The method of claim 4 wherein the calculated borehole axial magnetic measurement from the first orientation is compared to the calculated borehole axial magnetic component from the second orientation before computing the azimuth angle of the first orientation.

6. The method of claim 1 wherein the measurements of the earth's gravitational field are taken at the same orientation as the measurements of the earth's magnetic field at each of the plurality of orientations of the surveying instrument in the borehole.

7. A method of determining the orientation of a surveying instrument in a borehole comprising:

measuring the earth's gravitational field at a first orientation of a surveying instrument in a borehole;

measuring the radial components of the earth's magnetic field at the first orientation of the surveying instrument;

calculating the magnetic field along the borehole longitudinal axis at the first orientation of the surveying instrument from the measurements of the earth's gravitational field and the measurements of the radial components of the earth's magnetic field at the first orientation of the surveying instrument;

measuring the earth's gravitational field at a second orientation of the surveying instrument in the borehole;

measuring the radial components of the earth's magnetic field at the second orientation of the surveying instrument;

calculating the magnetic field along the borehole longitudinal axis at the second orientation of the surveying instrument from the measurements of the earth's gravitational field and the measurements of the radial components of the earth's magnetic field at the second orientation of the surveying instrument;

comparing the calculated magnetic field along the borehole longitudinal axis at the first orientation of the surveying instrument with the calculated magnetic field along the borehole longitudinal axis at second orientation of the surveying instrument; and computing the azimuth angle at the first and second orientations of the surveying instrument from the measurements of the earth's gravitational field, the measurements of the radial components of the earth's magnetic field, and the calculated magnetic field along the borehole longitudinal axis at each of the respective first and second orientations of the surveying instrument.

8. The method of claim 7 additionally comprising calculating the dip angle directly from the measurements of the earth's gravitational field, the measurements of the radial components of the earth's magnetic field and the calculated magnetic field along the borehole longitudinal axis at each of the respective first and second orientations of the surveying instrument.

9. The method of claim 7 wherein the first and second orientations of the surveying instrument are non-colinear.

10. A method of determining the orientation of a surveying instrument in a borehole comprising:

measuring the earth's gravitational and magnetic fields at a plurality of orientations of a surveying instrument in a borehole;

calculating the borehole axial magnetic component at each said orientation from the gravitational and magnetic field measurements without measuring the magnetic field along the longitudinal borehole axis; and computing the azimuth angle of each said orientation directly from said gravitational and magnetic field measurements and the calculated borehole axial magnetic component.

11. The method of claim 10 wherein the orientations of the surveying instrument in the borehole are non-colinear.

12. The method of claim 10 additionally comprising comparing the calculated borehole axial magnetic compound from a first orientation of the surveying instrument to the calculated borehole axial magnetic component from a second orientation of the surveying instrument.

13. The method of claim 12 wherein the calculated borehole axial magnetic component from the first orientation is compared to the calculated borehole axial magnetic component from the second orientation by computing the azimuth angle of the first orientation.

14. The method of claim 10 additionally comprising calculating the dip angle from said gravitational and magnetic field measurements and the calculated borehole axial magnetic component.

15. The method of claim 10 wherein the measurements of the earth's gravitational and magnetic fields are both taken at each of said plurality of orientations in the borehole.

* * * * *